US006427564B1

(12) United States Patent
Nelson

(10) Patent No.: US 6,427,564 B1
(45) Date of Patent: Aug. 6, 2002

(54) SOCKET HAND GRIP DEVICE

(76) Inventor: Willie J. Nelson, Rte. 4 Box 333, Marion, NC (US) 28752

( * ) Notice: Subject to any disclaimer, the term of this patent is extended or adjusted under 35 U.S.C. 154(b) by 0 days.

(21) Appl. No.: 09/785,136

(22) Filed: Feb. 16, 2001

(51) Int. Cl.[7] ..... B25B 23/16
(52) U.S. Cl. ..... 81/177.2; 81/177.1
(58) Field of Search ..... 81/177.1, 177.2

(56) References Cited

U.S. PATENT DOCUMENTS

| | | | | | |
|---|---|---|---|---|---|
| 1,775,402 | A | | 9/1930 | Mandl | |
| 2,523,041 | A | | 9/1950 | Mckenzie | |
| 2,697,370 | A | | 12/1954 | Brooks | |
| 2,725,086 | A | * | 11/1955 | Keyes et al. | 81/177.2 X |
| 2,982,160 | A | | 5/1961 | Little | |
| 3,823,624 | A | * | 7/1974 | Martin | 81/177.2 X |
| 3,875,829 | A | * | 4/1975 | Evans et al. | 81/177.2 X |
| 4,350,064 | A | * | 9/1982 | Markle | 81/177.2 X |
| D334,516 | S | | 4/1993 | Tsunoda | |
| 5,361,656 | A | | 11/1994 | Starr | |
| 5,485,769 | A | | 1/1996 | Olson et al. | |
| 6,079,298 | A | * | 6/2000 | Gasperi et al. | 81/177.1 X |
| 6,286,395 | B1 | * | 9/2001 | Frazier | 81/177.2 X |

* cited by examiner

*Primary Examiner*—James G. Smith

(57) ABSTRACT

A socket hand grip device for providing torque on a socket. The socket hand grip device includes a hand grip having a top side, a bottom side and a peripheral side extending between the top and bottom sides. The hand grip has a hole therein extending through the top and bottom sides. The hole is generally positioned along an axis of the hand grip and has a generally rectangular shape such that the hole has four inner side walls. A coupling member removably couples one of the sockets to the hand grip. The coupling member includes a first portion for extending into the hole. The first portion has a generally rectangular cross-section such that the first portion may be extended into the bottom side of the hand grip. A middle portion is integrally coupled to an end of the first portion. A second portion for extending into an opening of a socket is integrally coupled to the middle portion and is generally coaxial with the first portion.

14 Claims, 3 Drawing Sheets

SOCKET HAND GRIP DEVICE

BACKGROUND OF THE INVENTION

1. Field of the Invention

The present invention relates to socket tools and more particularly pertains to a new socket hand grip device for providing torque on a socket.

2. Description of the Prior Art

The use of socket tools is known in the prior art. More specifically, socket tools heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 2,697,370; 5,361,656; 1,775,402; 2,523,041; 5,485,769; and 2,982,160; U.S. Des. Pat. No. 334,516.

While these devices fulfill their respective, particular objectives and requirements, the aforementioned patents do not disclose a new socket hand grip device. The inventive device includes a hand grip having a top side, a bottom side and a peripheral side extending between the top and bottom sides. The hand grip has a hole therein extending through the top and bottom sides. The hole is generally positioned along an axis of the hand grip and has a generally rectangular shape such that the hole has four inner side walls. A coupling member removably couples one of the sockets to the hand grip. The coupling member includes a first portion for extending into the hole. The first portion has a generally rectangular cross-section such that the first portion may be extended into the bottom side of the hand grip. A middle portion is integrally coupled to an end of the first portion. A second portion for extending into an opening of a socket is integrally coupled to the middle portion and is generally coaxial with the first portion.

In these respects, the socket hand grip device according to the present invention substantially departs from the conventional concepts and designs of the prior art, and in so doing provides an apparatus primarily developed for the purpose of providing torque on a socket.

SUMMARY OF THE INVENTION

In view of the foregoing disadvantages inherent in the known types of socket tools now present in the prior art, the present invention provides a new socket hand grip device construction wherein the same can be utilized for providing torque on a socket.

The general purpose of the present invention, which will be described subsequently in greater detail, is to provide a new socket hand grip device apparatus and method which has many of the advantages of the socket tools mentioned heretofore and many novel features that result in a new socket hand grip device which is not anticipated, rendered obvious, suggested, or even implied by any of the prior art socket tools, either alone or in any combination thereof.

To attain this, the present invention generally comprises a hand grip having a top side, a bottom side and a peripheral side extending between the top and bottom sides. The hand grip has a hole therein extending through the top and bottom sides. The hole is generally positioned along an axis of the hand grip and has a generally rectangular shape such that the hole has four inner side walls. A coupling member removably couples one of the sockets to the hand grip. The coupling member includes a first portion for extending into the hole. The first portion has a generally rectangular cross-section such that the first portion may be extended into the bottom side of the hand grip. A middle portion is integrally coupled to an end of the first portion. A second portion for extending into an opening of a socket is integrally coupled to the middle portion and is generally coaxial with the first portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new socket hand grip device apparatus and method which has many of the advantages of the socket tools mentioned heretofore and many novel features that result in a new socket hand grip device which is not anticipated, rendered obvious, suggested, or even implied by any of the prior art socket tools, either alone or in any combination thereof.

It is another object of the present invention to provide a new socket hand grip device which may be easily and efficiently manufactured and marketed.

It is a further object of the present invention to provide a new socket hand grip device which is of a durable and reliable construction.

An even further object of the present invention is to provide a new socket hand grip device which is susceptible of a low cost of manufacture with regard to both materials and labor, and which accordingly is then susceptible of low prices of sale to the consuming public, thereby making such socket hand grip device economically available to the buying public.

Still yet another object of the present invention is to provide a new socket hand grip device which provides in the apparatuses and methods of the prior art some of the advantages thereof, while simultaneously overcoming some of the disadvantages normally associated therewith.

Still another object of the present invention is to provide a new socket hand grip device for providing torque on a socket.

Yet another object of the present invention is to provide a new socket hand grip device which includes a hand grip having a top side, a bottom side and a peripheral side extending between the top and bottom sides. The hand grip has a hole therein extending through the top and bottom sides. The hole is generally positioned along an axis of the hand grip and has a generally rectangular shape such that the hole has four inner side walls. A coupling member removably couples one of the sockets to the hand grip. The coupling member includes a first portion for extending into the hole. The first portion has a generally rectangular cross-section such that the first portion may be extended into the bottom side of the hand grip. A middle portion is integrally coupled to an end of the first portion. A second portion for extending into an opening of a socket is integrally coupled to the middle portion and is generally coaxial with the first portion.

Still yet another object of the present invention is to provide a new socket hand grip device that allows use of sockets in difficult and hard to reach areas.

Even still another object of the present invention is to provide a new socket hand grip device that has a hexagonal protruding member thereon for being gripped by a wrench for additional torque.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
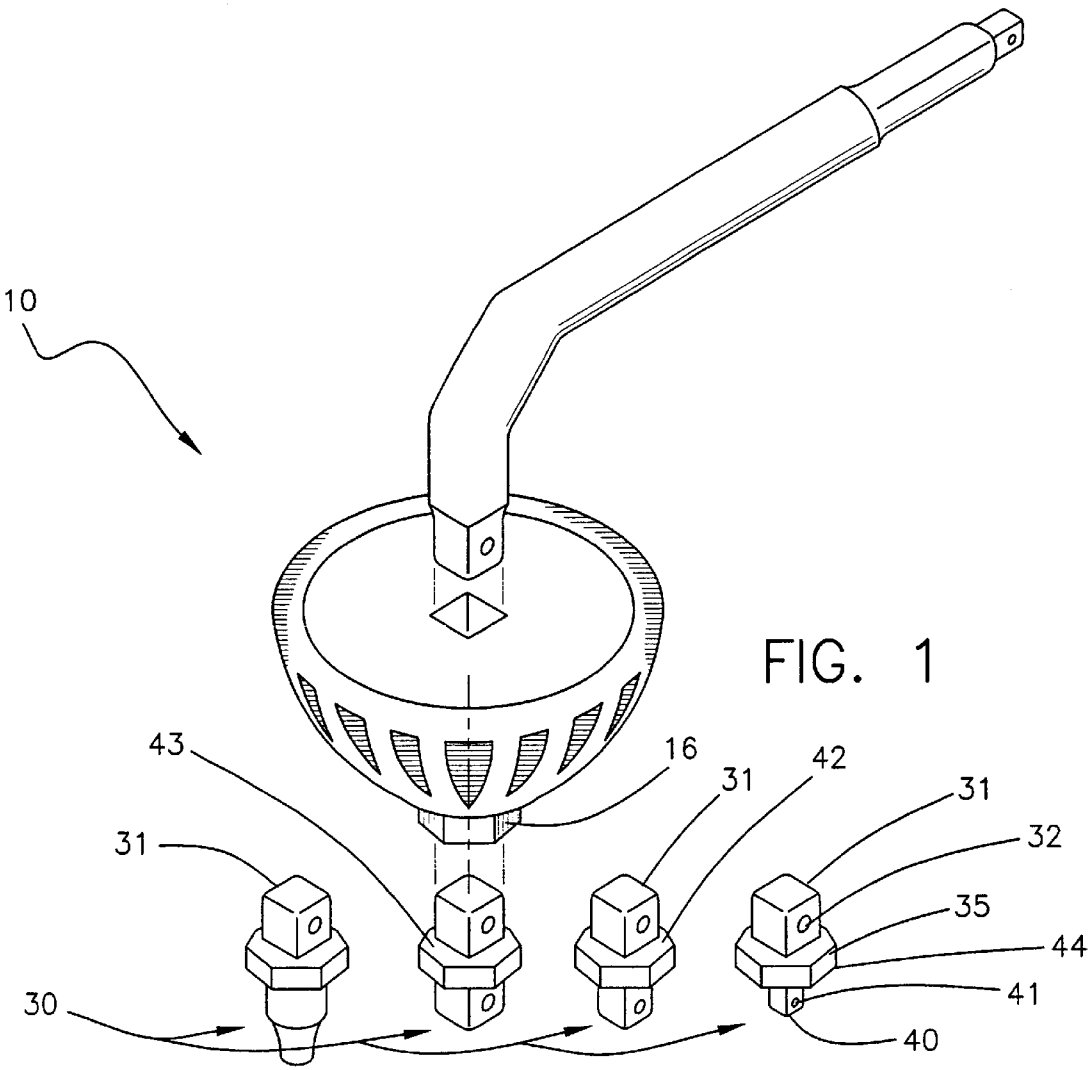
FIG. 1 is a schematic perspective view of a new socket hand grip device according to the present invention.
Figure 2:
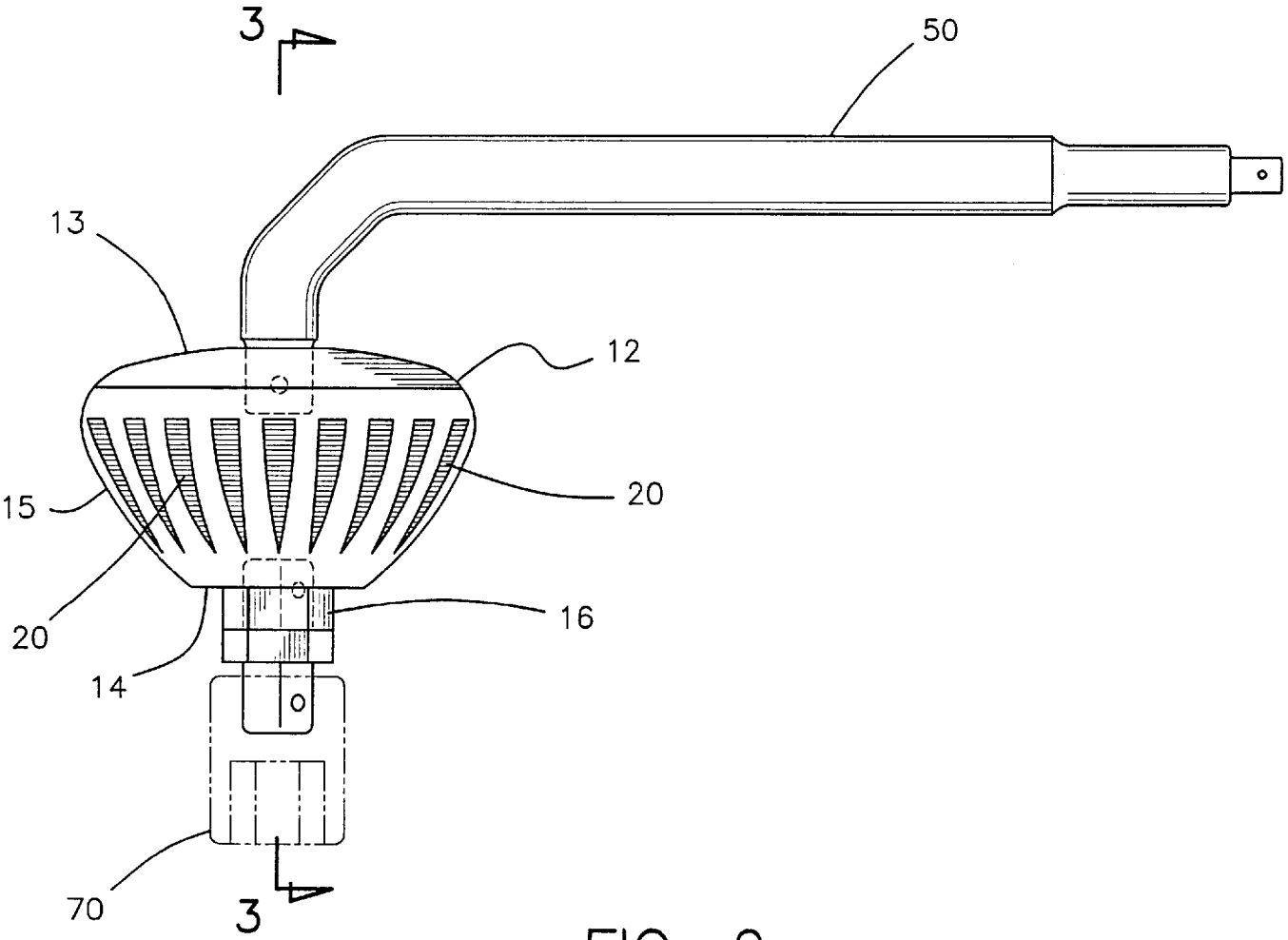
FIG. 2 is a schematic side view of the present invention.
Figure 3:
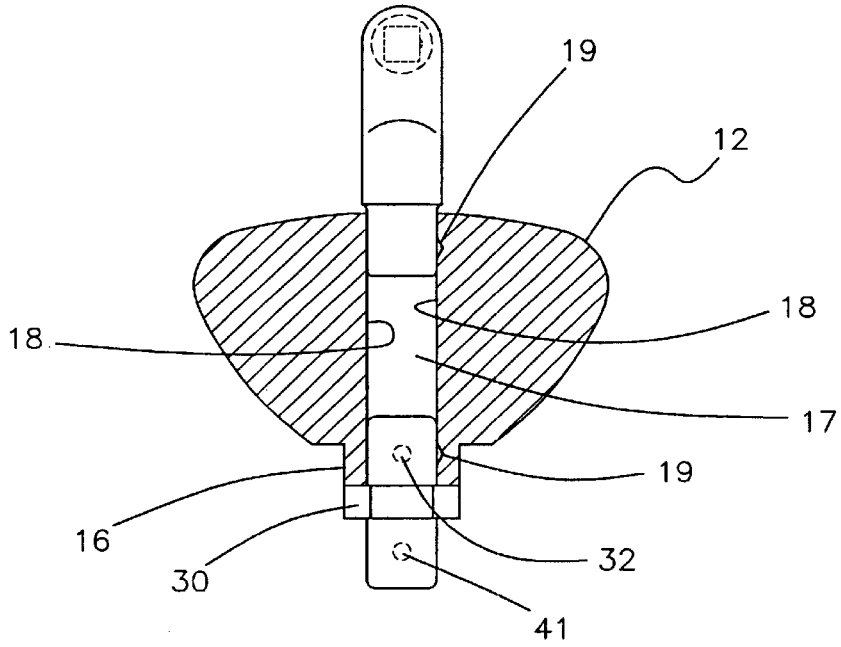
FIG. 3 is a schematic cross-sectional view taken along line 3—3 of the present invention.
Figure 4:
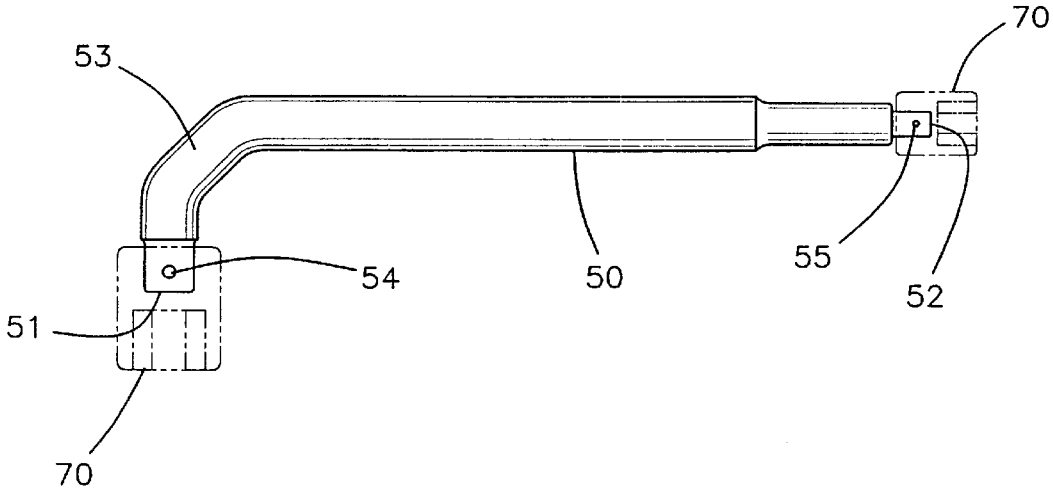
FIG. 4 is a schematic side view of the torque bar of the present invention.

With reference now to the drawings, and in particular to FIGS. 1 through 4 thereof, a new socket hand grip device embodying the principles and concepts of the present invention and generally designated by the reference numeral 10 will be described.

As best illustrated in FIGS. 1 through 4, the socket hand grip device 10 generally comprises a system for engaging a plurality of conventional sockets 70. The sockets 70 each have an opening therein having a generally rectangular shape and inner surface walls with depressions therein for receiving a coupling member from the system 10. The system 10 includes a hand grip 12 having a top side 13, a bottom side 14 and a peripheral side 15 extending between the top 13 and bottom 14 sides. A protruding member 16 is integrally coupled to and extends away from the bottom side 14. The protruding member 16 has a generally hexagonal cross-section taken perpendicular to a line extending through the top 13 and bottom 14 sides. The hand grip 12 has a hole 17 therein extending through the top 13 and bottom 12 sides and through the protruding member 16. The hole 17 is generally positioned along an axis of the hand grip 12. The hole 17 has a generally rectangular shape such that the hole has four inner side walls 18. At least one of the side walls has a pair of depressions 19 therein and ideally each of the inner side walls 18 has a pair of depressions therein positioned such that each of the side walls 18 has one depression 19 located generally adjacent to the top 13 and bottom 14 sides. The top side 13 has a width greater than the bottom side 14. The top side 13 preferably has a width generally between 3 inches and 6 inches. The peripheral wall 15 has a plurality of elongated channels 20 therein generally extending from the top side 13 to the bottom side 14. The hand grip 12 has a generally circular shaped cross section taken perpendicular to the line extending through the top 13 and bottom 14 sides.

Each of a plurality of coupling members 30 removably couples one of the sockets 70 to the hand grip 12. Each of the coupling members 30 includes a first portion 31, a middle portion 35 and a second portion 40. The first portion 31 is for extending into the hole 17. The first portion 31 has a generally rectangular cross-section such that the first portion 31 may be positioned in the hole 17. A detent 32 is positioned in and is outwardly biased from an outer surface of the first portion 31. The first portion 31 is extendable into the bottom side 14 of the hand grip 12 such that the detent 32 may be positioned in a depression 19 to removably couple the first portion 31 to the hand grip 12.

The middle portion 35 comprises a plate integrally coupled to an end of the first portion 31. The plate 35 ideally has a width and shape generally identical to the protruding member 16. The hexagonal shape of the protruding member 16 and the plate 35 allow a user to position a wrench about them for increasing torque on the socket 70.

The second portion 40 is for extending into an opening in one of the sockets 70. The second portion 40 is integrally coupled to the middle portion 35 and is generally coaxial with the first portion 32. The second portion 40 has a generally rectangular cross-section such that the second portion may be positioned in the socket 70. A detent 41 is positioned in and outwardly biased from an outer surface of the second portion 40. The second portion 40 is extendable into the socket 70 such that the detent 41 in the second portion 40 may be positioned in one of the depressions in the socket 70 to removably couple the second portion to the socket 70.

Ideally there is a first coupling member 42, a second coupling member 43 and a third coupling member 44. The first coupling member 42 has a second portion 40 having a width substantially equal to ½ inch. The second coupling member 43 has a second portion 40 having a width substantially equal to ⅜ inch. The third coupling member 44 has a second portion 40 having a width substantially equal to ¼ inch. The different sizes allow for use of multiple sized sockets.

A torque bar 50 for applying torque to the hand grip comprises an elongated member having a first end 51 and a second end 52. The elongated member, or torque bar 50, has a bend 53 therein positioned nearer the first end 51 than the second end 52 and substantially equals 90 degrees. The first end 51 has a size and shape generally equal to the first portions 31 of the coupling members 30 for extending into the hole 17. The first end 51 of the torque bar 50 has a generally rectangular cross-section to be positioned in the hole 17 in the hand grip 12. A first detent 54 is positioned in and outwardly biased from an outer surface of the torque bar 50 and positioned generally adjacent to the first end 51. The first end 51 is extendable into the top side 13 of the hand grip 12 such that the first detent 54 in the torque bar 50 may be positioned in one of the depressions 19 to removably couple the torque bar 50 to the hand grip 12. The second end 52 has a generally rectangular cross-section such that the second end 52 of the torque bar may be positioned in one of the sockets 40. A second detent 55 is positioned in and outwardly biased from an outer surface of the torque bar 50 and positioned generally adjacent to the second end 52. The second end 52 is extendable into the socket 70 such that the second detent 55 may be positioned in one of the depressions in the socket 70 to removably couple the second end 52 to the socket 70.

In use, the second portion of the coupling member is positionable in a socket. The first portion is extending into the hole through the bottom side of the hand grip. The hand grip may then be used to rotate the socket. The torque bar may be used if the bolt or nut being removed is overly tight to add additional rotational torque on the hand grip. A wrench may also be used on the middle portion and protruding member to also add torque.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A handle system for engaging a plurality of sockets, the sockets each having an opening therein having a generally rectangular shape and having inner surface walls with depressions therein, said system comprising:

a hand grip, said hand grip having a top side, a bottom side and a peripheral side extending between said top and bottom sides, said hand grip having a hole therein, said hole extending through said top and bottom sides, said hole being generally positioned along an axis of said hand grip, said hole having a generally rectangular shape such that said hole has four inner side walls;

a coupling member for removably coupling one of said sockets to said hand grip, said coupling member comprising;

a first portion for extending into said hole, said first portion having a generally rectangular cross-section such that said first portion may be positioned in said hole, wherein said first portion is extendable into said bottom side of said hand grip; and a middle portion integrally coupled to an end of said first portion, wherein said middle portion of said coupling member comprises a plate, said plate having a peripheral wall having a hexagonal cross-section taken perpendicular to a line extending through said first portion and said second portion;

a second portion for extending into an opening in one of the sockets, said second portion being integrally coupled to said middle portion and being generally coaxial with said first portion, said second portion having a generally rectangular cross-section such that said second portion may be positioned in one of said sockets.

2. The handle system as in claim 1, wherein a protruding member being integrally coupled to and extending away from said bottom side, said protruding member having a generally hexagonal cross-section taken perpendicular to a line extending through said top and bottom sides, said hole extending through said protruding member.

3. The handle system as in claim 1, wherein:

one of said inner side walls having a pair of depressions therein positioned such that one depression is located generally adjacent to said top and bottom sides; and a detent being positioned in and being outwardly biased from an outer surface of said first portion, wherein said first portion is extendable into said bottom side of said hand grip such that said detent may be positioned in one of said depressions to removably couple said first portion to said hand grip.

4. The handle system as in claim 1, wherein said top side has a width greater than said bottom side, said top side having a width generally between 3 inches and 6 inches.

5. The handle system as in claim 4, wherein said peripheral wall has a plurality of elongated channels therein generally extending from said top side to said bottom side.

6. The handle system as in claim 5, wherein said hand grip has a generally circular shaped cross section taken perpendicular to a line extending through said top and bottom sides.

7. The handle system as in claim 1, wherein said peripheral wall has a plurality of elongated channels therein generally extending from said top side to said bottom side.

8. The handle system as in claim 7, wherein said hand grip has a generally circular shaped cross section taken perpendicular to a line extending through said top and bottom sides.

9. The handle system as in claim 1, wherein a detent being positioned in and outwardly biased from an outer surface of said second portion, wherein said second portion is extendable into said socket such that said detent in said second portion may be positioned in one of said depressions in said socket to removably couple said second portion to said socket.

10. The handle system as in claim 7, further including:

a plurality of coupling members, wherein there is a first coupling member, a second coupling member and a third coupling member, said first coupling member having a second portion having a width substantially equal to ½ inch, said second coupling member having a second portion having a width substantially equal to ⅜ inch, said third coupling member having a second portion having a width substantially equal to ¼ inch.

11. The handle system as in claim 1, further including:

a torque bar for applying torque to said hand grip, said torque bar comprising an elongated member having a first end and a second end, said elongated member having a bend therein positioned nearer said first end than said second end, said bend being substantially equal to 90 degrees, said first end having a size and shape generally equal to said first portion of said coupling members for extending into said hole, said first end of said torque bar having a generally rectangular cross-section to be positioned in said hole. in said hand grip, wherein said first end is extendable into said top side of said hand grip.

12. The handle system as in claim 11, wherein said second end has a generally rectangular cross-section such that said second end of said torque bar may be positioned in one of said sockets.

13. The handle system as in claim 3, further including:

a torque bar for applying torque to said hand grip, said torque bar comprising an elongated member having a first end and a second end, said elongated member having a bend therein positioned nearer said first end than said second end, said bend being substantially equal to 90 degrees, said first end having a size and shape generally equal to said first portion of said coupling members for extending into said hole, said first end of said torque bar having a generally rectangular cross-section to be positioned in said hole in said hand grip, a first detent being positioned in and outwardly biased from an outer surface of said torque bar and positioned generally adjacent to said first end, wherein said first end is extendable into said top side of said hand grip such that said first detent in said torque bar may be positioned in one of said depressions to removably couple said torque bar to said hand grip.

14. A handle system for engaging a plurality of sockets, the sockets each having an opening therein having a generally rectangular shape and having inner surface walls with depressions therein, said system comprising:

a hand grip, said hand grip having a top side, a bottom side and a peripheral side extending between said top and bottom sides, a protruding member being integrally coupled to and extending away from said bottom side, said protruding member having a generally hexagonal cross-section taken perpendicular to a line extending through said top and bottom sides, said hand grip having a hole therein, said hole extending through said top and bottom sides and through said protruding member, said hole being generally positioned along an axis of said hand grip, said hole having a generally rectangular shape such that said hole has four inner side walls, each of said inner side walls having a pair of depressions therein positioned such that each of said side walls has one depression located generally adjacent to said top and bottom sides, said top side having a width greater than said bottom side, said top side having a width generally between 3 inches and 6 inches, said peripheral wall having a plurality of elongated channels therein generally extending from said top side to said bottom side, said hand grip having a generally circular shaped cross section taken perpendicular to said line extending through said top and bottom sides;

a plurality of coupling members for removably coupling one of said sockets to said hand grip, each of said coupling members comprising;

a first portion for extending into said hole, said first portion having a generally rectangular cross-section such that said first portion may be positioned in said hole, a detent being positioned in and biased outwardly from an outer surface of said first portion, wherein said first portion is extendable into said bottom side of said hand grip such that said detent may be positioned in one of said depressions to removably couple said first portion to said hand grip;

a middle portion comprising a plate integrally coupled to an end of said first portion, wherein said middle portion of said coupling member comprises a plate, said plate having a peripheral wall having a hexagonal cross-section taken perpendicular to a line extending through said first portion and said second portion, said plate having a width and shape generally identical to said protruding member;

a second portion for extending into an opening in one of the sockets, said second portion being integrally coupled to said middle portion and being generally coaxial with said first portion, said second portion having a generally rectangular cross-section such that said second portion may be positioned in said socket, a detent being positioned in and outwardly biased from an outer surface of said second portion, wherein said second portion is extendable into said socket such that said detent in said second portion may be positioned in one of said depressions in said socket to removably couple said second portion to said socket;

wherein there is a first coupling member, a second coupling member and a third coupling member, said first coupling member having a second portion having a width substantially equal to ½ inch, said second coupling member having a second portion having a width substantially equal to ⅜ inch, said third coupling member having a second portion having a width substantially equal to ¼ inch; and a torque bar for applying torque to said hand grip, said torque bar comprising an elongated member having a first end and a second end, said elongated member having a bend therein positioned nearer said first end than said second end, said bend being substantially equal to 90 degrees, said first end having a size and shape generally equal to said first portion of said coupling members for extending into said hole, said first end of said torque bar having a generally rectangular cross-section to be positioned in said hole in said hand grip, a first detent being positioned in and outwardly biased from an outer surface of said torque bar and positioned generally adjacent to said first end, wherein said first end is extendable into said top side of said hand grip such that said first detent in said torque bar may be positioned in one of said depressions to removably couple said torque bar to said hand grip, said second end having a generally rectangular cross-section such that said second end of said torque bar may be positioned in one of said sockets, a second detent being positioned in and outwardly biased from an outer surface of said torque bar and positioned generally adjacent to said second end, wherein said second end is extendable into said socket such that said second detent may be positioned in one of said depressions in said socket to removably couple said second end to said socket.

* * * * *